United States Patent [19]

Schaller

[11] Patent Number: 4,615,560

[45] Date of Patent: Oct. 7, 1986

[54] ADJUSTABLE CHILDREN'S CHAIR

[76] Inventor: Herta Schaller, Gusshauserstr. 6, A 1040 Wien, Austria

[21] Appl. No.: 550,865

[22] Filed: Nov. 10, 1983

[30] Foreign Application Priority Data

Nov. 12, 1982 [AT] Austria ..... 4126/82

[51] Int. Cl.[4] ..... A47C 13/00

[52] U.S. Cl. ..... 297/130; 297/250; 297/254

[58] Field of Search ..... 297/130, 346, 345, 118, 297/254, 250, 255, 256; 248/420

[56] References Cited

U.S. PATENT DOCUMENTS

| | | | |
|---|---|---|---|
| 2,292,414 | 8/1942 | Vernon | 297/313 |
| 2,435,733 | 2/1948 | Belyeu | 297/130 |
| 2,599,610 | 6/1952 | Clairmonte et al. | 297/130 X |
| 2,792,054 | 5/1957 | Muoio | 297/345 X |
| 2,805,076 | 9/1957 | Thomas | 297/130 |
| 3,116,069 | 12/1963 | Dostal | 297/254 X |
| 3,542,419 | 11/1970 | Spinola | 297/130 |
| 3,550,998 | 12/1970 | Boudreau et al. | 297/254 |
| 3,625,563 | 12/1971 | Dikinson | 297/345 |
| 3,645,548 | 2/1972 | Briner | 297/254 X |
| 4,036,523 | 7/1977 | Nelson | 297/130 |

FOREIGN PATENT DOCUMENTS

| | | |
|---|---|---|
| 0050017 | 4/1982 | European Pat. Off. . |
| 1809240 | 11/1968 | Fed. Rep. of Germany . |
| 1963006 | 1/1971 | Fed. Rep. of Germany . |
| 3101605 | 8/1982 | Fed. Rep. of Germany . |
| 2322570 | 4/1977 | France . |
| 2416673 | 9/1979 | France . |

*Primary Examiner*—James T. McCall

*Attorney, Agent, or Firm*—Karl F. Ross; Herbert Dubno

[57] ABSTRACT

A chair for children has a base frame from whose sides two parallel lateral struts rise with a rearward slant, these struts being engaged by a pair of sleeves that are indexable at different levels thereon. The sleeves are rigid with respective lugs on which a seat-supporting bail is pivotable about a horizontal axis, the bail being immobilizable in a selected angular position by a handwheel through the intermediary of a jaw clutch. The base frame, normally resting on the floor, can also be suspended from a headpost of a bed.

11 Claims, 4 Drawing Figures

17
21
7
20
2
12
7"
1'
18
19
3
13
16
15
4
11
6
7'
1

20
20
2
2
9
8
10
5
11
21
15
15
6
13
14
3
4
3
4
1'
1'
1

ADJUSTABLE CHILDREN'S CHAIR

FIELD OF THE INVENTION

My present invention relates to a chair designed for safely accommodating small children of various ages.

BACKGROUND OF THE INVENTION

The usual high chair comprises a seat which is supported on a fixed framework and is therefore not adjustable to accommodate children of different sizes and in different situations.

OBJECTS OF THE INVENTION

The general object of my present invention, therefore, is to provide a chair for infants and other small children in which such adjustments are possible.

A more particular object is to provide a chair of this description which can either stand up on the floor or be suspended from an elevated support such as, for example, a headpost of a bed in which a child is to be fed or perhaps medically examined.

SUMMARY OF THE INVENTION

A children's chair according to my invention comprises a framework in the form of a base frame with a pair of sidebars from which a pair of parallel struts rise at an acute angle. A pair of sliders respectively mounted on these struts are provided with indexing means by which they can be immobilized at a selected level. The sliders, in turn, carry seat-supporting means pivotally mounted thereon for rotation about a horizontal axis, the seat-supporting means being connected with clamping means in order to be fastened in a selected angular position relative to the sliders.

Advantageously, the base frame includes a transverse rear member interconnecting its sidebars to stabilize the framework, the struts being joined to the sidebars at locations remote from that rear member and sloping rearward from these locations, preferably at an angle of approximately 45° with reference to the base frame. Such a structure enables the framework of the chair to be suspended from a headpost or other elevated support with the aid of suitable coupling means such as simple hooks engaging its rear member. The angular adjustability of the seat-supporting means will then allow the seat to be placed in the proper position despite the rotation of the base frame through 90°.

The seat-supporting means may be designed as a U-shaped element or bail embracing a bucket seat at or near the junction of its bottom with its backrest. The struts, furthermore, conveniently enable the mounting of a tray—as used in conventional high chairs—in front of the bucket seat.

BRIEF DESCRIPTION OF THE DRAWING

The above and other features of my invention will now be described in detail with reference to the accompanying drawing in FIG. 1 is a side-elevational view of a children's chair according to my invention, equipped with a bucket seat and shown suspended from a headpost of a bed.

SPECIFIC DESCRIPTION

Figure 3:
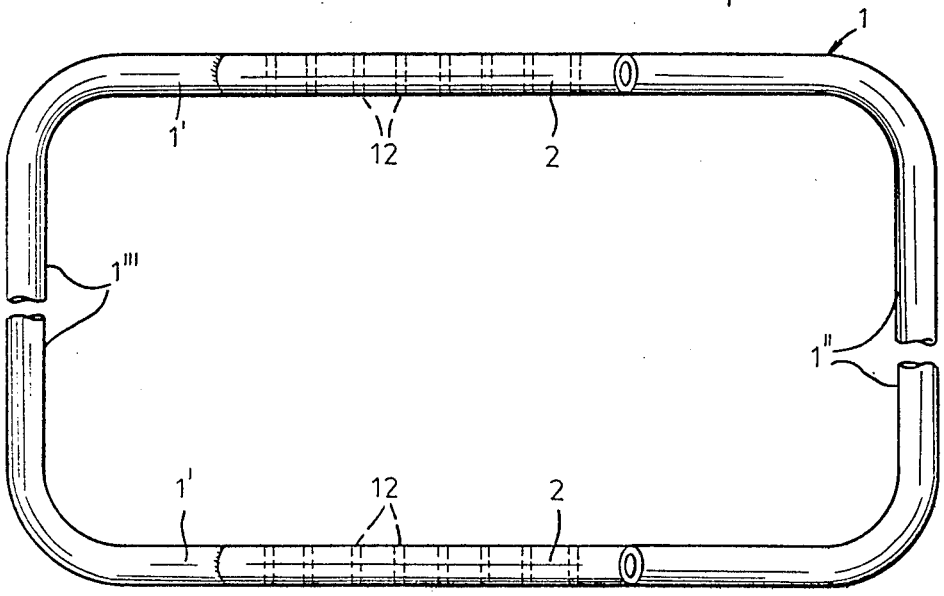
FIG. 3 is a top view of the framework of the chair shown in FIGS. 1 and 2.

As shown in the drawing, a children's chair according to my invention comprises a generally rectangular metallic base frame 1 with sidebars 1', a rear member 1'' and a front member 1'''; the latter member may be omitted if the frame 1 has the necessary rigidity. Two struts 2 rise from forward extremities of sidebars 1' to which they are welded, sloping rearward at an angle of about 45° to these sidebars but terminating well ahead of the rear member 1'' as viewed from above in FIG. 3. The free ends of struts 2 are provided with removable bumpers 20 of rubber or the like for protective purposes.

Struts 2, which like the members of frame 1 are tubular, are each formed with a multiplicity of transverse indexing bores 12 spaced apart in their longitudinal direction. The struts are slidably engaged by respective sleeves 3 having parallel lugs 4 welded thereto, these lugs extending generally forward at right angles to the struts. Each sleeve 3 has a laterally projecting tubular boss 21 in which a pin 13 provided with a milled head 15 is slidable to serve as a detent engaging in one of the bores 12 of the associated strut 2; the pins are provided with tension springs 14 serving to hold them in the engaged bores for securely indexing the sleeves 3 at a desired level relative to frame 1.

The left-hand lug 4 (as viewed from the front in FIG. 4) is rigid with a toothed jaw 9 of a jaw clutch whose other jaw 8 is fixed to one lateral leg of a bail 6 serving as a support for a bucket seat 7. The two jaws 8, 9 are traversed by a bolt 5 whose outwardly projecting end is threadedly engaged by a handwheel 10 whereby the two jaws can be positively clamped together in any selected angular position of bail 6 relative to lugs 4; the clutch 8, 9 will maintain that position even in the face of violent motions of a child occupying the seat 7. The opposite lug 4 carries a stud 11 penetrating the right-hand leg of bail 6 as viewed in FIG. 4. The bail 6, in turn, is riveted or otherwise secured to bucket seat 7 at the junction of its bottom 7' with its backrest 7''. The seat 7 may be provided with a nonillustrated safety belt closable about the body of an infant by a suitable fastener, preferably one of burr type known under the name Velcro; such a fastener could be disposed on a plate secured to the rear of the backrest 7'' to which the ends of the belt can thus be attached.

Figure 1:
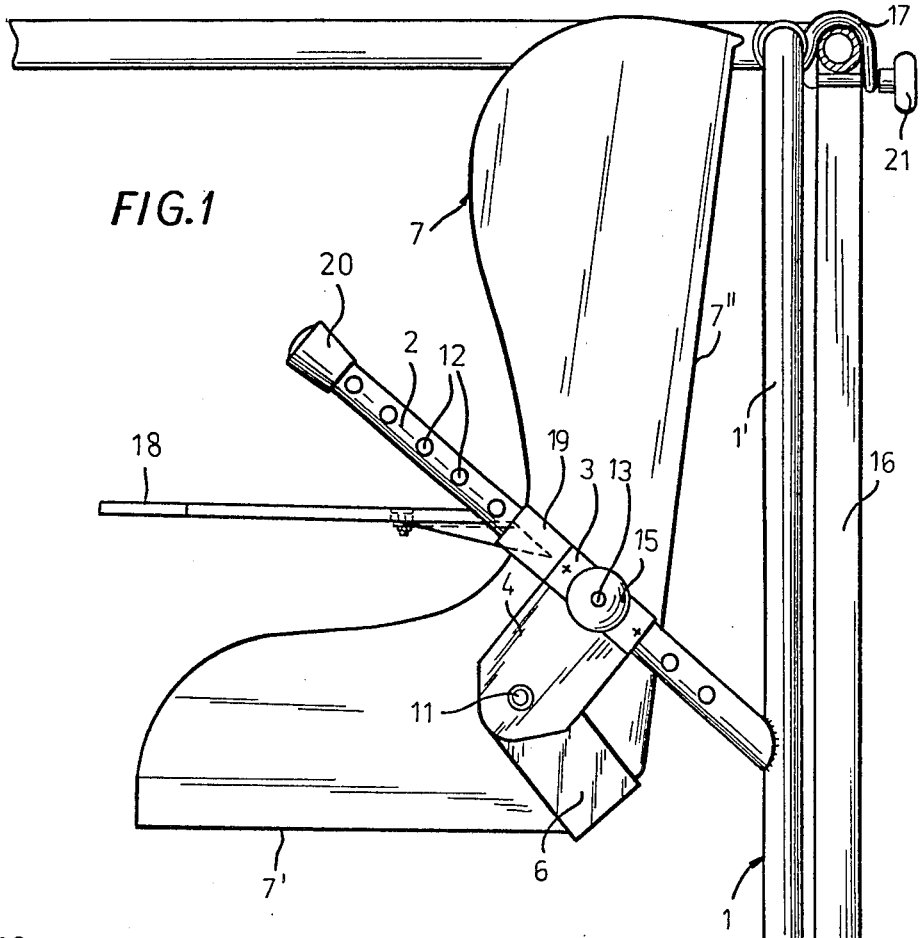
Figure 4:
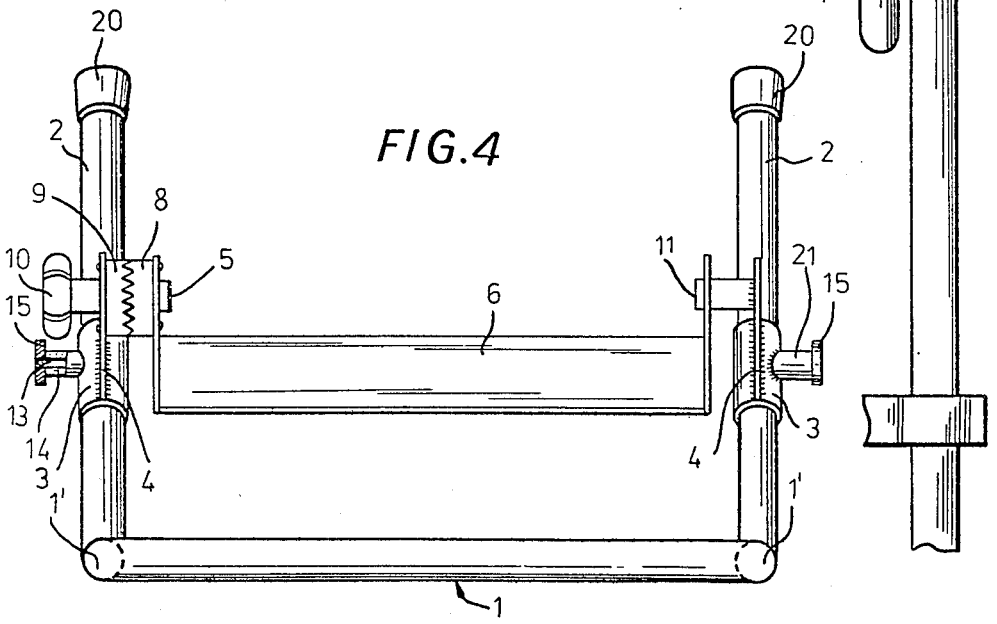
FIG. 4 is a front view of the chair with its bucket seat removed.
Figure 2:
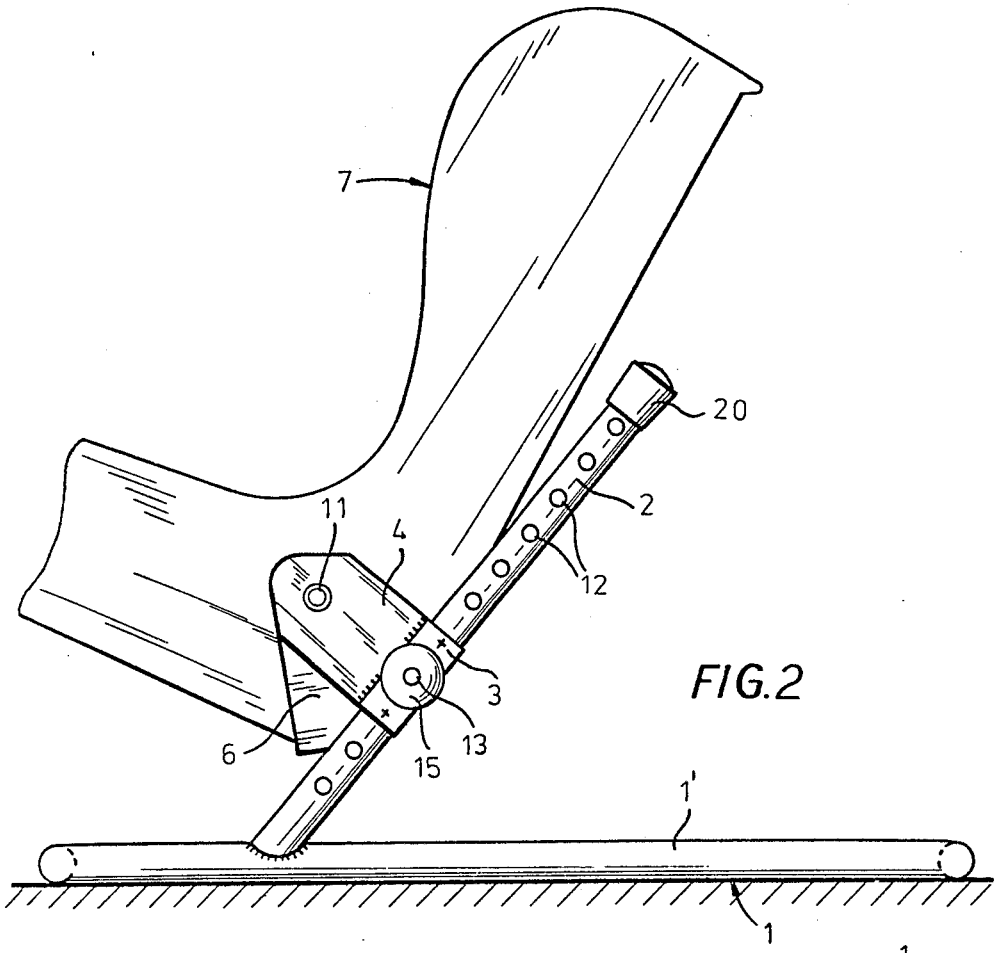
FIG. 2 is a similar view of the same chair resting on the floor of a room.

FIGS. 2 and 4 show the framework 1, 2 in its normal position designed to support the seat 7 with a suitable attitude selectable by the clamping means 8–10. FIG. 1, on the other hand, shows this framework suspended by hooks 17, engaging its rear member 1'', from the top of a headpost 16 of a crib in which the child can be seated at a level convenient for feeding; a tray 18 provided with a pair of tubular lateral sockets 19 can be placed in front of the child by fitting these sockets on the struts 2 (after temporary removal of bumpers 20) and letting them slide down into contact with sleeves 3. Each hook 17 (only one shown) is provided with a manual clamp 21 in order to be firmly connected to the top bar of the headpost. The same kind of suspension could be used in a hospital bed to facilitate a medical examination of the child.

I claim:

1. A children's chair comprising:

a base frame with a pair of sidebars;

a pair of parallel struts rising from said sidebars at an acute angle thereto;

a pair of sliders respectively mounted on said struts and provided with indexing means for immobilizing same at a selected level;

seat-supporting means pivotally mounted on said sliders and rotatable thereon about a horizontal axis;

a seat having a seating portion rigid with a backrest mounted on said seat supporting means; and clamping means connected with said seat-supporting means for fastening same in a selected angular position relative to said sliders.

2. A children's chair as defined in claim 1 wherein said base frame includes a transverse rear member interconnecting said sidebars, said struts being joined to said sidebars at forward locations remote from said rear member and sloping rearward from said locations.

3. A children's chair as defined in claim 2 wherein said struts including an angle of approximately 45° with said base frame.

4. A children's chair as defined in claim 3, further comprising coupling means on said rear member for suspending said base frame generally vertically from an elevated support.

5. A children's chair as defined in claim 1 wherein said struts are provided with a multiplicity of longitudinally spaced-apart transverse bores, said indexing means comprising spring-loaded detents on said sliders selectively insertable into said bores.

6. A children's chair comprising:

a base frame with a pair of sidebars;

a pair of parallel struts rising from said sidebars at an acute angle thereto;

a pair of sliders respectively mounted on said struts and provided with indexing means for immobilizing same at a selected level;

seat-supporting means pivotally mounted on said sliders and rotatable thereon about a horizontal axis; and clamping means connected with said seat-supporting means for fastening same in a selected angular position relative to said sliders, said clamping means comprising a jaw clutch with coacting jaws respectively secured to said seat-supporting means and to one of said sliders.

7. A children's chair as defined in claim 6 wherein said indexing means further comprises a bolt traversing said jaws and a handwheel threadedly engaging said bolt.

8. A children's chair as defined in claim 1 wherein said sliders comprise sleeves surrounding said struts and lugs projecting parallel to each other from said sleeves.

9. A children's chair comprising:

a base frame with a pair of sidebars;

a pair of parallel struts rising from said sidebars at an acute angle thereto;

a pair of sliders respectively mounted on said struts and provided with indexing means for immobilizing same at a selected level;

seat-supporting means pivotally mounted on said sliders and rotatable thereon about a horizontal axis; and clamping means connected with said seat-supporting means for fastening same in a selected angular position relative to said sliders, said sliders comprising sleeves surrounding said struts and lugs projecting parallel to each other from said sleeves, said seat-supporting means comprising a bail fulcrumed on free ends of said lugs.

10. A children's chair as defined in claim 1, further comprising a tray provided with sockets fitting around said struts for positioning in front of said seat.

11. A children's chair as defined in claim 1 wherein said struts have free ends provided with removable protective bumpers.

* * * * *